US007108067B2

(12) United States Patent
Themig et al.

(10) Patent No.: US 7,108,067 B2
(45) **Date of Patent: *Sep. 19, 2006**

(54) METHOD AND APPARATUS FOR WELLBORE FLUID TREATMENT

(75) Inventors: Daniel Jon Themig, Calgary (CA); Jim Fehr, Edmonton (CA)

(73) Assignee: Packers Plus Energy Services Inc., Calgary (CA)

( * ) Notice: Subject to any disclaimer, the term of this patent is extended or adjusted under 35 U.S.C. 154(b) by 219 days.

This patent is subject to a terminal disclaimer.

(21) Appl. No.: 10/604,807

(22) Filed: Aug. 19, 2003

(65) Prior Publication Data

US 2004/0118564 A1 Jun. 24, 2004

Related U.S. Application Data

(60) Provisional application No. 60/404,783, filed on Aug. 21, 2002.

(51) Int. Cl.
*E21B 34/14* (2006.01)

(52) U.S. Cl. ..... 166/317; 166/154; 166/164; 166/169; 166/186; 166/194; 166/250.17; 166/332.4; 166/334.4

(58) Field of Classification Search ..... 166/154, 166/164, 169, 250.17, 263, 279, 291, 296, 166/305.1, 306, 310, 312, 317, 332.4, 334.4, 166/373, 383, 386
See application file for complete search history.

(56) References Cited

U.S. PATENT DOCUMENTS

| | | | | |
|---|---|---|---|---|
| 4,031,957 | A * | 6/1977 | Sanford | 166/264 |
| 4,099,563 | A * | 7/1978 | Hutchison et al. | 166/191 |
| 4,499,951 | A * | 2/1985 | Vann | 166/297 |
| 4,577,702 | A | 3/1986 | Faulkner | |
| 5,411,095 | A | 5/1995 | Ehlinger et al. | |
| 5,533,571 | A | 7/1996 | Surjaatmadja et al. | |
| 6,006,838 | A | 12/1999 | Whiteley et al. | |
| 6,065,541 | A | 5/2000 | Allen | |
| 6,189,619 | B1 | 2/2001 | Wyatt et al. | |
| 6,390,200 | B1 * | 5/2002 | Allamon et al. | 166/376 |
| 6,651,743 | B1 * | 11/2003 | Szarka | 166/285 |

OTHER PUBLICATIONS

Information on RockSeal Open Hole Packers, these or similar packers believed to be publicly available in the US prior to Aug. 19, 2002.

* cited by examiner

*Primary Examiner*—Zakiya W. Bates
(74) *Attorney, Agent, or Firm*—Bennett Jones LLP

(57) ABSTRACT

A tubing string assembly for fluid treatment of a wellbore includes substantially pressure holding closures spaced along the tubing string, which each close at least one port through the tubing string wall. The closures are openable by a sleeve drivable through the tubing string inner bore.

12 Claims, 6 Drawing Sheets

METHOD AND APPARATUS FOR WELLBORE FLUID TREATMENT

BACKGROUND OF INVENTION

The invention relates to a method and apparatus for wellbore fluid treatment and, in particular, to a method and apparatus for selective flow control to a wellbore for fluid treatment.

An oil or gas well relies on inflow of petroleum products. When drilling an oil or gas well, an operator may decide to leave productive intervals uncased (open hole) to expose porosity and permit unrestricted wellbore inflow of petroleum products. Alternately, the hole may be cased with a liner, which is then perforated to permit inflow through the openings created by perforating.

When natural inflow from the well is not economical, the well may require wellbore treatment termed stimulation. This is accomplished by pumping stimulation fluids such as fracturing fluids, acid, cleaning chemicals and/or proppant laden fluids to improve wellbore inflow.

In one previous method, the well is isolated in segments and each segment is individually treated so that concentrated and controlled fluid treatment can be provided along the wellbore. Often, in this method a tubing string is used with inflatable element packers thereabout which provide for segment isolation. The packers, which are inflated with pressure using a bladder, are used to isolate segments of the well and the tubing is used to convey treatment fluids to the isolated segment. Such inflatable packers may be limited with respect to pressure capabilities as well as durability under high pressure conditions. Generally, the packers are run for a wellbore treatment, but must be moved after each treatment if it is desired to isolate other segments of the well for treatment. This process can be expensive and time consuming. Furthermore, it may require stimulation pumping equipment to be at the well site for long periods of time or for multiple visits. This method can be very time consuming and costly.

Other procedures for stimulation treatments use tubing strings without packers such that tubing is used to convey treatment fluids to the wellbore, the fluid being circulated up hole through the annulus between the tubing and the wellbore wall or casing.

The tubing string, which conveys the treatment fluid, can include ports or openings for the fluid to pass therethrough into the borehole. Where more concentrated fluid treatment is desired in one position along the wellbore, a small number of larger ports are used. In another method, where it is desired to distribute treatment fluids over a greater area, a perforated tubing string is used having a plurality of spaced apart perforations through its wall. The perforations can be distributed along the length of the tube or only at selected segments. The open area of each perforation can be preselected to control the volume of fluid passing from the tube during use. When fluids are pumped into the liner, a pressure drop is created across the sized ports. The pressure drop causes approximate equal volumes of fluid to exit each port in order to distribute stimulation fluids to desired segments of the well.

In many previous systems, it is necessary to run the tubing string into the bore hole with the ports or perforations already opened. This is especially true where a distributed application of treatment fluid is desired such that a plurality of ports or perforations must be open at the same time for passage therethrough of fluid. This need to run in a tube already including open perforations can hinder the running operation and limit usefulness of the tubing string.

Some sleeve systems have been proposed for flow control through tubing ports. However, the ports are generally closely positioned such that they can all be covered by the sleeve.

SUMMARY OF INVENTION

A method and apparatus has been invented which provides for selective communication to a wellbore for fluid treatment. In one aspect, the method and apparatus provide for the running in of a fluid treatment string, the fluid treatment string having ports substantially closed against the passage of fluid therethrough, but which are openable when desired to permit fluid flow into the wellbore. The apparatus and methods of the present invention can be used in various borehole conditions including open holes, lined or cased holes, vertical, inclined or horizontal holes, and straight or deviated holes.

In one embodiment, there is provided an apparatus for fluid treatment of a borehole, the apparatus comprising a tubing string having a long axis, a plurality of closures accessible from the inner diameter of the tubing string, each closure closing a port opened through the wall of the tubing string and preventing fluid flow through its port, but being openable to permit fluid flow through its port and each closure openable independently from each other closure and a port opening sleeve positioned in the tubing string and driveable through the tubing string to actuate the plurality of closures to open the ports.

The sleeve can be driven in any way to move through the tubing string to actuate the plurality of closures. In one embodiment, the sleeve is driveable remotely, without the need to trip a work string such as a tubing string, coiled tubing or a wire line.

In one embodiment, the sleeve has formed thereon a seat and the apparatus includes a sealing device selected to seal against the seat, such that fluid pressure can be applied to drive the sleeve and the sealing device can seal against fluid passage past the sleeve. The sealing device can be, for example, a plug or a ball, which can be deployed without connection to surface. This embodiment avoids the need for tripping in a work string for manipulation.

In one embodiment, the closures each include a cap mounted over its port and extending into the tubing string inner bore, the cap being openable by the sleeve engaging against. The cap, when opened, permits fluid flow through the port. The cap can be opened, for example, by action of the sleeve breaking open the cap or shearing the cap from its position over the port.

In another embodiment, the closures each include a port-closure sleeve mounted over at least one port and openable by the sleeve engaging and moving the port-closure sleeve away from its associated at least one port. The port-closure sleeve can include, for example, a profile on its surface open to the tubing string and the port-opening sleeve includes a locking dog biased outwardly therefrom and selected to engage the profile on the port-closure sleeve such that the port-closure sleeve is moved by the port opening sleeve. The profile is formed such that the locking dog can disengage therefrom, permitting the sleeve to move along the tubing string to a next port-closure sleeve.

In one embodiment, the apparatus can include a packer about the tubing string. The packers can be of any desired type to seal between the wellbore and the tubing string. For example, the packer can be a solid body packer including multiple packing elements.

In view of the foregoing there is provided a method for fluid treatment of a borehole, the method comprising: providing an apparatus for wellbore treatment according to one of the various embodiments of the invention; running the tubing string into a wellbore to a position for treating the wellbore; moving the sleeve to open the closures of the ports and increasing fluid pressure to force wellbore treatment fluid out through the ports.

In one method according to the present invention, the fluid treatment is a borehole stimulation using stimulation fluids such as one or more of acid, gelled acid, gelled water, gelled oil, $CO_2$, nitrogen and any of these fluids containing proppants, such as for example, sand or bauxite. The method can be conducted in an open hole or in a cased hole. In a cased hole, the casing may have to be perforated prior to running the tubing string into the wellbore, in order to provide access to the formation.

The method can include setting a packer about the tubing string to isolate the fluid treatment to a selected section of the wellbore.

BRIEF DESCRIPTION OF DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION

Figure 1:
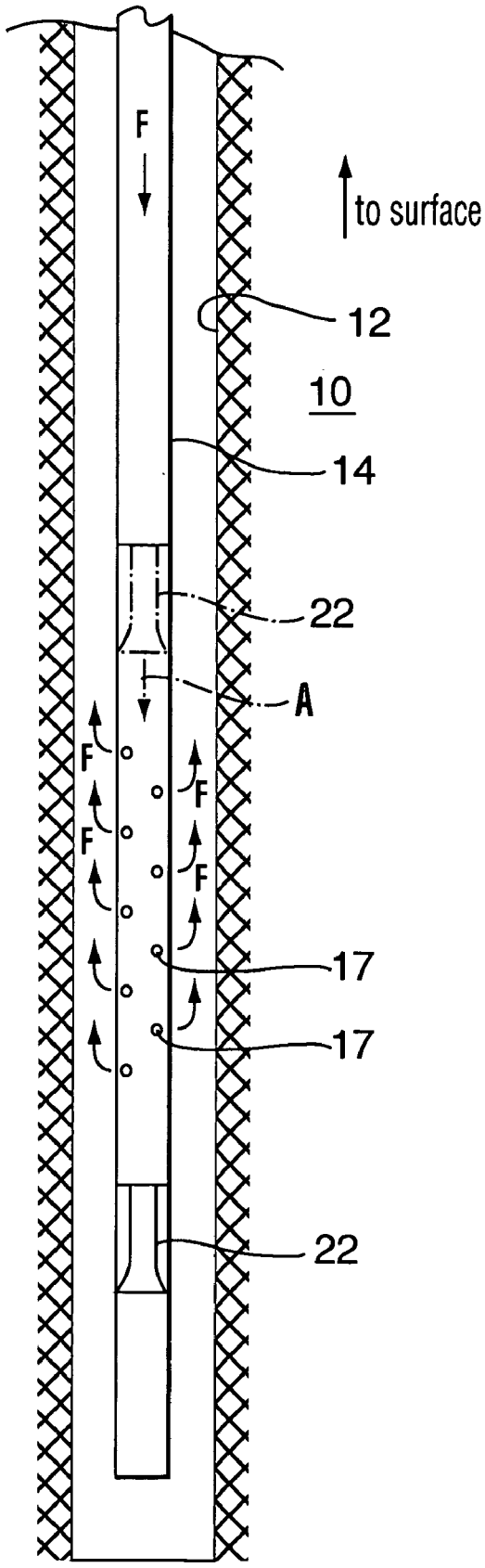
FIG. 1 is a sectional view through a wellbore having positioned therein a fluid treatment assembly according to the present invention.

Referring to FIG. 1, a wellbore fluid treatment assembly is shown, which can be used to effect fluid treatment of a formation 10 through a wellbore 12. The wellbore assembly includes a tubing string 14 having a lower end 14*a* and an upper end extending to surface (not shown). Tubing string 14 includes a plurality of spaced apart ports 17 opened through the tubing string wall to permit access between the tubing string inner bore 18 and the wellbore. Each port 17 includes thereover a closure that can be closed to substantially prevent, and selectively opened to permit, fluid flow through the ports.

A port-opening sleeve 22 is disposed in the tubing string to control the opening of the port closures. In this embodiment, sleeve 22 is mounted such that it can move, arrow A, from a port closed position, wherein the sleeve is shown in phantom, axially through the tubing string inner bore past the ports to a open port position, shown in solid lines, to open the associated closures of the ports allowing fluid flow therethrough. The sliding sleeve is disposed to control the opening of the ports through the tubing string and is moveable from a closed port position to a position wherein the ports have been opened by passing of the sleeve and fluid flow of, for example, stimulation fluid is permitted down through the tubing string, arrows F, through the ports of the ported interval. If fluid flow is continued, the fluid can return to surface through the annulus.

The tubing string is deployed into the borehole in the closed port position and can be positioned down hole with the ports at a desired location to effect fluid treatment of the borehole.

Figure 2:
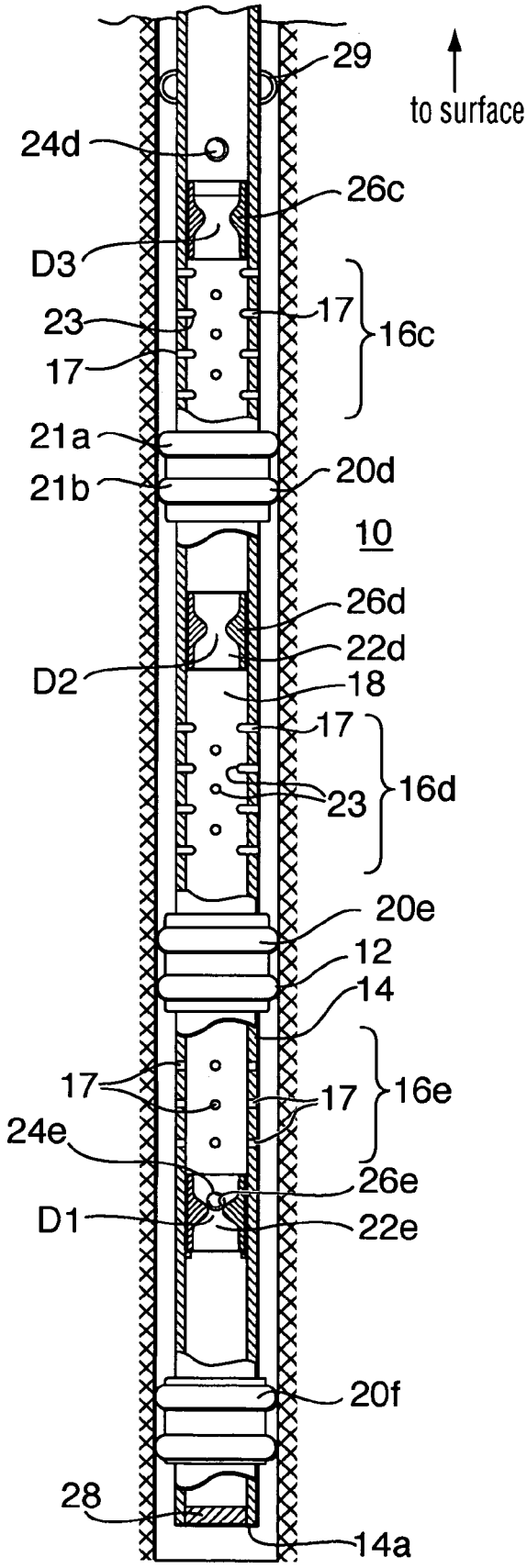
FIG. 2 is a sectional view through a wellbore having positioned therein a fluid treatment assembly according to the present invention.

Referring to FIG. 2, a wellbore fluid treatment assembly is shown, which can be used to effect fluid treatment of a formation 10 through a wellbore 12. The wellbore assembly includes a tubing string 14 having a lower end 14*a* and an upper end extending to surface (not shown). Tubing string 14 includes a plurality of spaced apart ported intervals 16*c* to 16*e* each including a plurality of ports 17 opened through the tubing string wall to permit access between the tubing string inner bore 18 and the wellbore. The ports are normally closed by pressure holding caps 23.

Packers 20*d* to 20*e* are mounted between each pair of adjacent ported intervals. In the illustrated embodiment, a packer 20*f* is also mounted below the lower most ported interval 16*e* and lower end 14*a* of the tubing string. Although not shown herein, a packer can be positioned above the upper most ported interval. The packers are disposed about the tubing string and selected to seal the annulus between the tubing string and the wellbore wall, when the assembly is disposed in the wellbore. The packers divide the wellbore into isolated segments wherein fluid can be applied to one segment of the well, but is prevented from passing through the annulus into adjacent segments. As will be appreciated the packers can be spaced in any way relative to the ported intervals to achieve a desired interval length or number of ported intervals per segment. In addition, packer 20*f* need not be present in some applications.

The packers can be, as shown, of the solid body-type with at least one extrudable packing element, for example, formed of rubber. Solid body packers including multiple, spaced apart packing elements 21*a*, 21*b* on a single packer are particularly useful especially for example in open hole (unlined wellbore) operations. In another embodiment, a plurality of packers are positioned in side by side relation on the tubing string, rather than using only one packer between each ported interval.

Sliding sleeves 22*c* to 22*e* are disposed in the tubing string to control the opening of the ports by opening the caps. In this embodiment, a sliding sleeve is mounted for each ported interval and can be moved axially through the tubing string inner bore to open the caps of its interval. In particular, the sliding sleeves are disposed to control the opening of their ported intervals through the tubing string and are each moveable from a closed port position away from the ports of the ported interval (as shown by sleeves 22*c* and 22*d*) to a position wherein it has moved past the ports to break open the caps and wherein fluid flow of, for example, stimulation fluid is permitted through the ports of the ported interval (as shown by sleeve 22*e*).

The assembly is run in and positioned downhole with the sliding sleeves each in their closed port position. When the tubing string is ready for use in fluid treatment of the wellbore, the sleeves are moved to their port open positions. The sleeves for each isolated interval between adjacent packers can be opened individually to permit fluid flow to one wellbore segment at a time, in a staged treatment process.

Preferably, the sliding sleeves are each moveable remotely, for example without having to run in a line or string for manipulation thereof, from their closed port position to their position permitting through-port fluid flow. In one embodiment, the sliding sleeves are actuated by devices, such as balls 24*d*, 24*e* (as shown) or plugs, which can be conveyed by gravity or fluid flow through the tubing string. The device engages against the sleeve and causes it to move4 through the tubing string. In this case, ball 24*e* is sized so that it cannot pass through sleeve 22*e* and is engaged in it when pressure is applied through the tubing string inner bore 18 from surface, ball 24*e* seats against and plugs fluid flow past the sleeve. Thus, when fluid pressure is applied after the ball has seated in the sleeve, a pressure differential is created above and below the sleeve which drives the sleeve toward the lower pressure side.

In the illustrated embodiment, the inner surface of each sleeve, which is the side open to the inner bore of the tubing string, defines a seat 26*e* onto which an associated ball 24*e*, when launched from surface, can land and seal thereagainst. When the ball seals against the sleeve seat and pressure is applied or increased from surface, a pressure differential is set up which causes the sliding sleeve on which the ball has landed to slide through the tubing string to an port-open position until it is stopped by, for example, a no go. When the ports of the ported interval 16*e* are opened, fluid can flow therethrough to the annulus between the tubing string and the wellbore and thereafter into contact with formation 10.

Each of the plurality of sliding sleeves has a different diameter seat and, therefore, each accept a different sized ball. In particular, the lower-most sliding sleeve 22*e* has the smallest diameter D1 seat and accepts the smallest sized ball 24*e* and each sleeve that is progressively closer to surface has a larger seat. For example, as shown in FIG. 1*b*, the sleeve 22*c* includes a seat 26*c* having a diameter D3, sleeve 22*d* includes a seat 26*d* having a diameter D2, which is less than D3 and sleeve 22*e* includes a seat 26*e* having a diameter D1, which is less than D2. This provides that the lowest sleeve can be actuated to open it ports first by first launching the smallest ball 24*e*, which can pass though all of the seats of the sleeves closer to surface but which will land in and seal against seat 26*e* of sleeve 22*e*. Likewise, penultimate sleeve 22*d* can be actuated to move through ported interval 16*d* by launching a ball 24*d* which is sized to pass through all of the seats closer to surface, including seat 26*c*, but which will land in and seal against seat 26*d*.

Lower end 14*a* of the tubing string can be open, closed or fitted in various ways, depending on the operational characteristics of the tubing string which are desired. In the illustrated embodiment, the tubing string includes a pump out plug assembly 28. Pump out plug assembly 28 acts to close off end 14*a* during run in of the tubing string, to maintain the inner bore of the tubing string relatively clear. However, by application of fluid pressure, for example at a pressure of about 3000 psi, the plug can be blown out to permit actuation of the lower most sleeve 22*e* by generation of a pressure differential. As will be appreciated, an opening adjacent end 14*a* is only needed where pressure, as opposed to gravity, is needed to convey the first ball to land in the lower-most sleeve. Alternately, the lower most sleeve can be hydraulically actuated, including a fluid actuated piston secured by shear pins, so that the sleeve can be driven along the tubing string remotely without the need to land a ball or plug therein.

In other embodiments, not shown, end 14*a* can be left open or can be closed, for example, by installation of a welded or threaded plug.

While the illustrated tubing string includes three ported intervals, it is to be understood that any number of ported intervals could be used. In a fluid treatment assembly desired to be used for staged fluid treatment, at least two openable ports from the tubing string inner bore to the wellbore must be provided such as at least two ported intervals or an openable end and one ported interval. It is also to be understood that any number of ports can be used in each interval.

Centralizer 29 and other tubing string attachments can be used, as desired.

The wellbore fluid treatment apparatus, as described with respect to FIG. 2, can be used in the fluid treatment of a wellbore. For selectively treating formation 10 through wellbore 12, the above-described assembly is run into the borehole and the packers are set to seal the annulus at each location creating a plurality of isolated annulus zones. Fluids can then pumped down the tubing string and into a selected zone of the annulus, such as by increasing the pressure to pump out plug assembly 28. Alternately, a plurality of open ports or an open end can be provided or lower most sleeve can include a piston face for hydraulic actuation thereof. Once that selected zone is treated, as desired, ball 24*e* or another sealing plug is launched from surface and conveyed by gravity or fluid pressure to seal against seat 26*e* of the lower most sliding sleeve 22*e*, this seals off the tubing string below sleeve 22*e* and drives the sleeve to open the ports of ported interval 16*e* to allow the next annulus zone, the zone between packer 20*e* and 20*f*, to be treated with fluid. The treating fluids will be diverted through the ports of interval 16*e* whose caps have been removed by moving the sliding sleeve. The fluid can then be directed to a specific area of the formation. Ball 24*e* is sized to pass though all of the seats closer to surface, including seats 26*c*, 26*d*, without sealing thereagainst. When the fluid treatment through ports 16*e* is complete, a ball 24*d* is launched, which is sized to pass through all of the seats, including seat 26*c* closer to surface, and to seat in and move sleeve 22*d*. This opens the ports of ported interval 16*d* and permits fluid treatment of the annulus between packers 20*d* and 20*e*. This process of launching progressively larger balls or plugs is repeated until all of the zones are treated. The balls can be launched without stopping the flow of treating fluids. After treatment, fluids can be shut in or flowed back immediately. Once fluid pressure is reduced from surface, any balls seated in sleeve seats can be unseated by pressure from below to permit fluid flow upwardly therethrough.

The apparatus is particularly useful for stimulation of a formation, using stimulation fluids, such as for example, acid, gelled acid, gelled water, gelled oil, $CO_2$, nitrogen and/or proppant laden fluids.

Figure 3:
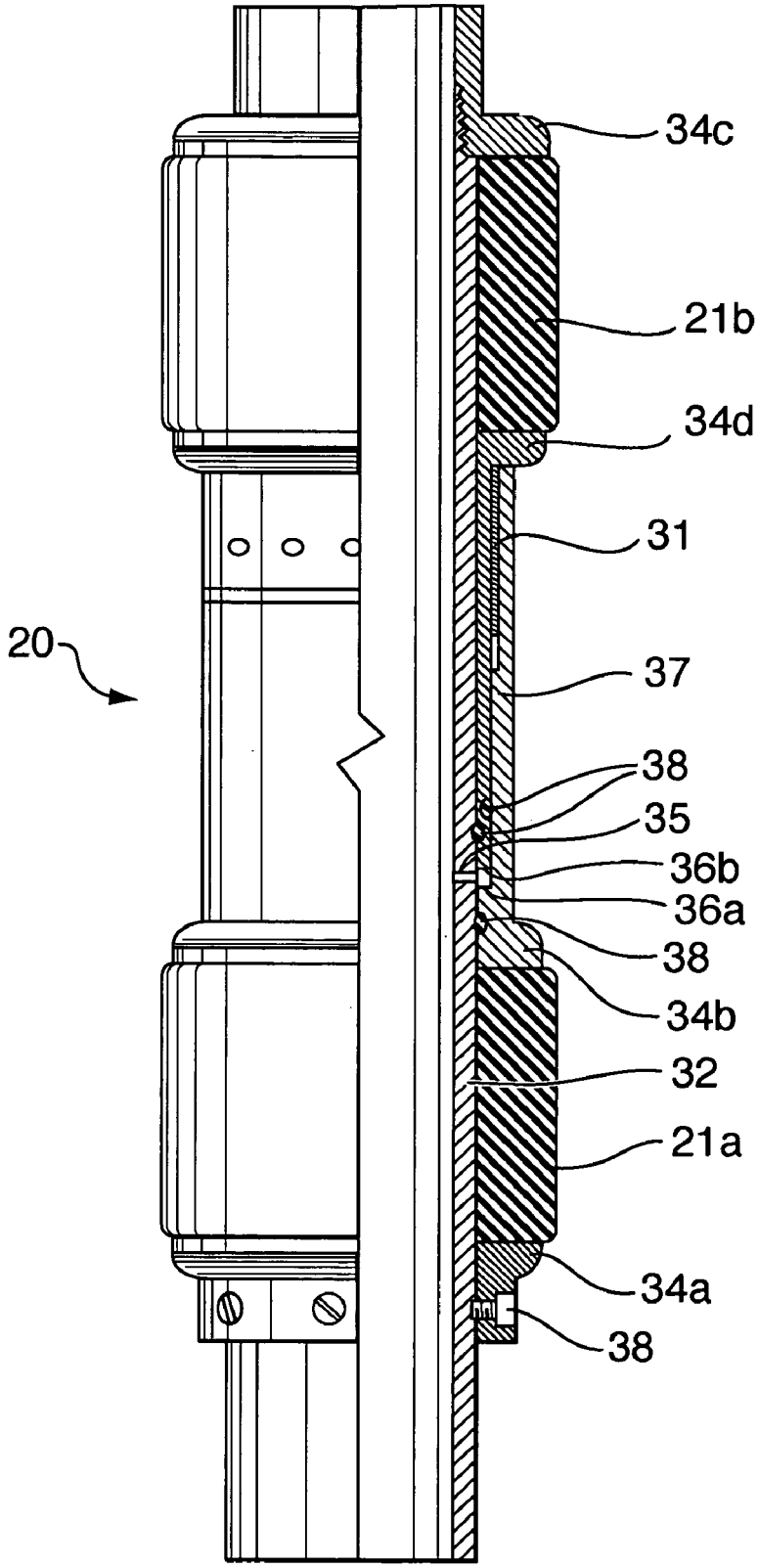
FIG. 3 is a sectional view along the long axis of a packer useful in the present invention.

Referring to FIG. 3, a packer 20 is shown which is useful in the present invention. The packer can be set using pressure or mechanical forces. Packer 20 includes extrudable packing elements 21*a*, 21*b*, a hydraulically actuated setting mechanism and a mechanical body lock system 31 including a locking ratchet arrangement. These parts are mounted on an inner mandrel 32. Multiple packing elements 21*a*, 21*b* are formed of elastomer, such as for example, rubber and include an enlarged cross section to provide excellent expansion ratios to set in oversized holes. The multiple packing elements 21*a*, 21*b* can be separated by at least 0.3M and preferably 0.8M or more. This arrangement of packing elements aid in providing high pressure sealing in an open borehole, as the elements load into each other to provide additional pack-off.

Packing element 21*a* is mounted between fixed stop ring 34*a* and compressing ring 34*b* and packing element 21*b* is mounted between fixed stop ring 34*c* and compressing ring 34*d*. The hydraulically actuated setting mechanism includes a port 35 through inner mandrel 32, which provides fluid access to a hydraulic chamber defined by first piston 36*a* and second piston 36*b*. First piston 36*a* acts against compressing ring 34*b* to drive compression and, therefore, expansion of packing element 21*a*, while second piston 36*b* acts against compressing ring 34*d* to drive compression and, therefore, expansion of packing element 21*b*. First piston 36*a* includes a skirt 37, which encloses the hydraulic chamber between the pistons and is telescopically disposed to ride over piston 36*b*. Seals 38 seal against the leakage of fluid between the parts. Mechanical body lock system 31, including for example a ratchet system, acts between skirt 37 and piston 36*b* permitting movement therebetween driving pistons 36*a*, 36*b* away from each other but locking against reverse movement of the pistons toward each other, thereby locking the packing elements into a compressed, expanded configuration.

Thus, the packer is set by pressuring up the tubing string such that fluid enters the hydraulic chamber and acts against pistons 36*a*, 36*b* to drive them apart, thereby compressing the packing elements and extruding them outwardly. This movement is permitted by body lock system 31. However, body lock system 31 locks the packers against retraction to lock the packing elements in their extruded conditions.

Ring 34*a* includes shears 38 which mount the ring to mandrel 32. Thus, for release of the packing elements from sealing position the tubing string into which mandrel 32 is connected, can be pulled up to release shears 38 and, thereby, release the compressing force on the packing elements.

Figure 4A:
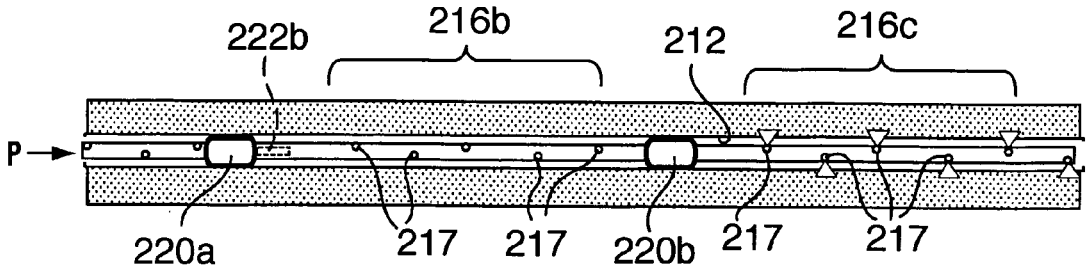
FIG. 4*a* is a section through another wellbore having positioned therein another fluid treatment assembly according to the present invention, the fluid treatment assembly being in a first stage of wellbore treatment.
Figure 4B:
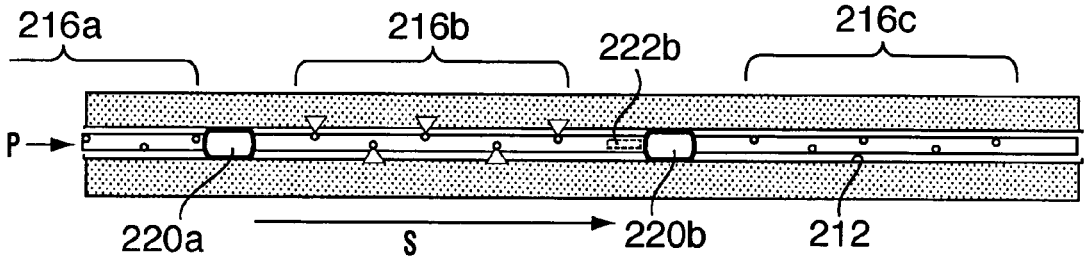
FIG. 4*b* is a section through the wellbore of FIG. 4*a* with the fluid treatment assembly in a second stage of wellbore treatment.
Figure 4C:
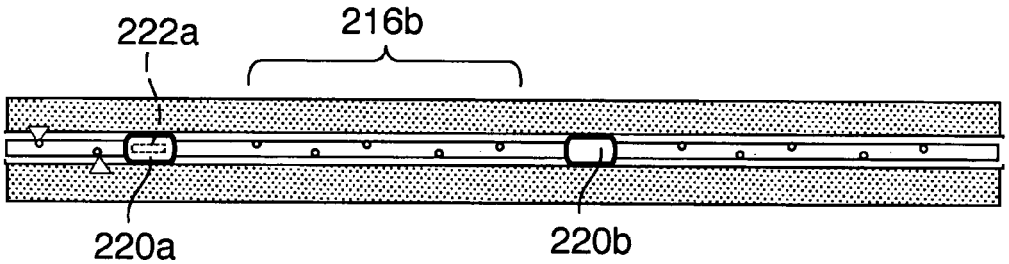
FIG. 4*c* is a section through the wellbore of FIG. 4*a* with the fluid treatment assembly in a third stage of wellbore treatment.

FIGS. 4*a* to 4*c* shows an assembly and method for fluid treatment, termed sprinkling, wherein fluid supplied to an isolated interval is introduced in a distributed, low pressure fashion along an extended length of that interval. The assembly includes a tubing string 212 and ported intervals 216*a*, 216*b*, 216*c* each including a plurality of ports 217 spaced along the long axis of the tubing string. Packers 220*a*, 220*b* are provided between each interval to form an isolated segment in the wellbore 212.

While the ports of interval 216*c* are open during run in of the tubing string, the ports of intervals 216*b* and 216*a*, are closed during run in and sleeves 222*a* and 222*b* are mounted within the tubing string and actuatable to selectively open the ports of intervals 216*a* and 216*b*, respectively. In particular, in FIG. 4*a*, the position of sleeve 222*b* is shown when the ports of interval 216*b* are closed. The ports in any of the intervals can be size restricted to create a selected pressure drop therethrough, permitting distribution of fluid along the entire ported interval.

Once the tubing string is run into the well, stage 1 is initiated wherein stimulation fluids are pumped into the end section of the well to ported interval 216*c* to begin the stimulation treatment (FIG. 4*a*). Fluids will be forced to the lower section of the well below packer 220*b*. In this illustrated embodiment, the ports of interval 216*c* are normally open size restricted ports, which do not require opening for stimulation fluids to be jetted therethrough. However, it is to be understood that the ports can be installed in closed configuration, but opened once the tubing is in place.

When desired to stimulate another section of the well (FIG. 4*b*), a ball or plug (not shown) is pumped by fluid pressure, arrow P, down the well and will seat in a selected sleeve 222*b* sized to accept the ball or plug. The pressure of the fluid behind the ball will push the cutter sleeve against any force or member, such as a shear pin, holding the sleeve in position and down the tubing string, arrow S. As it moves down, it will open the ports of interval 216*b* as it passes by them. Sleeve 222*b* eventually stops against a stop means. Since fluid pressure will hold the ball in the sleeve, this effectively shuts off the lower segment of the well including previously treated interval 216*c*. Treating fluids will then be forced through the newly opened ports. Using limited entry or a flow regulator, a tubing to annulus pressure drop insures distribution. The fluid will be isolated to treat the formation between packers 220*a* and 220*b*.

After the desired volume of stimulation fluids are pumped, a slightly larger second ball or plug is injected into the tubing and pumped down the well, and will seat in sleeve 222*a* which is selected to retain the larger ball or plug. The force of the moving fluid will push sleeve 222*a* down the tubing string and as it moves down, it will open the ports in interval 216*a*. Once the sleeve reaches a desired depth as shown in FIG. 4*c*, it will be stopped, effectively shutting off the lower segment of the well including previously treated intervals 216*b* and 216*c*. This process can be repeated a number of times until most or all of the wellbore is treated in stages, using a sprinkler approach over each individual section.

The above noted method can also be used for wellbore circulation to circulate existing wellbore fluids (drilling mud for example) out of a wellbore and to replace that fluid with another fluid. In such a method, a staged approach need not be used, but the sleeve can be used to open ports along the length of the tubing string. In addition, packers need not be used when the apparatus is intended for wellbore circulation as it is often desirable to circulate the fluids to surface through the wellbore annulus.

The sleeves 222*a* and 222*b* can be formed in various ways to cooperate with ports 217 to open those ports as they pass through the tubing string.

Figure 5:
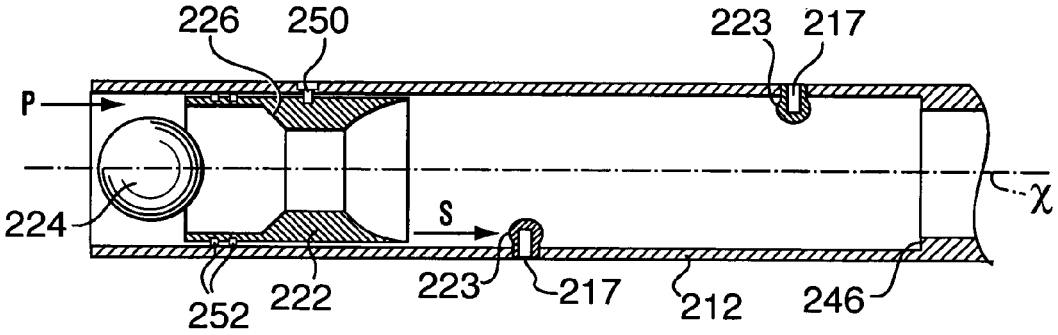
FIG. 5 is a sectional view along the long axis of a tubing string according to the present invention containing a sleeve and axially spaced fluid treatment ports.

With reference to FIG. 5, a tubing string 214 according to the present invention is shown including a movable sleeve 222 and a plurality of normally closed ports 217 spaced along the long axis x of the string. Ports 217 each include a pressure holding, internal cap 223. Cap 223 extends into the bore 218 of the tubing string and is formed of shearable material at least at its base, so that it can be sheared off to open the port. Cap 223 can be, for example, a cobe sub or other modified subs. As will be appreciated, due to the use of ball actuated sleeves, the caps are selected to be resistant to shearing by movement of a ball therepast.

Sleeve 222 is mounted in the tubing string and includes a cylindrical outer surface having a diameter to substantially conform to the inner diameter of, but capable of sliding through, the section of the tubing string in which the sleeve is selected to act. Sleeve 222 is mounted in tubing string by use of a shear pin 250 and has a seat 226 formed on its inner facing surface with a seat diameter to be plugged by a selected size ball 224 having a diameter greater than the seat diameter. When the ball is seated in the seat, and fluid pressure is applied therebehind, arrow P, shear pin 250 will shear and the sleeve will be driven, with the ball seated therein along the length of the tubing string until stopped by shoulder 246.

Sleeve 222 includes a profiled leading end 247 which is formed to shear or cut off the protective caps 223 from the ports as it passes, thereby opening the ports. Sleeve 222 and caps 223 are selected with consideration as to the fluid pressures to be used to substantially ensure that the sleeve can shear the caps from and move past the ports as it is driven through the tubing string.

While shoulder 246 is illustrated as an annular step on the inner diameter of the tubing string, it is to be understood that any configuration that stops movement of the sleeve though the wellbore can be used. Shoulder 246 is preferably spaced from the ports 217 with consideration as to the length of sleeve 222 such that when the sleeve is stopped against the shoulder, the sleeve does not cover any ports. Although not shown, the sleeve can be disposed in a circumferential groove in the tubing string, the groove having a diameter greater than the id of the tubing string. In such an embodiment, the sleeve could be disposed in the groove to eliminate or limit its extension into the tubing string inner diameter.

Sleeve 222 can include seals 252 to seal between the interface of the sleeve and the tubing string, where it is desired to seal off fluid flow therebetween.

The caps can also be used to close off ports disposed in a plane orthogonal to the long axis of the tubing string, if desired.

Figure 6:
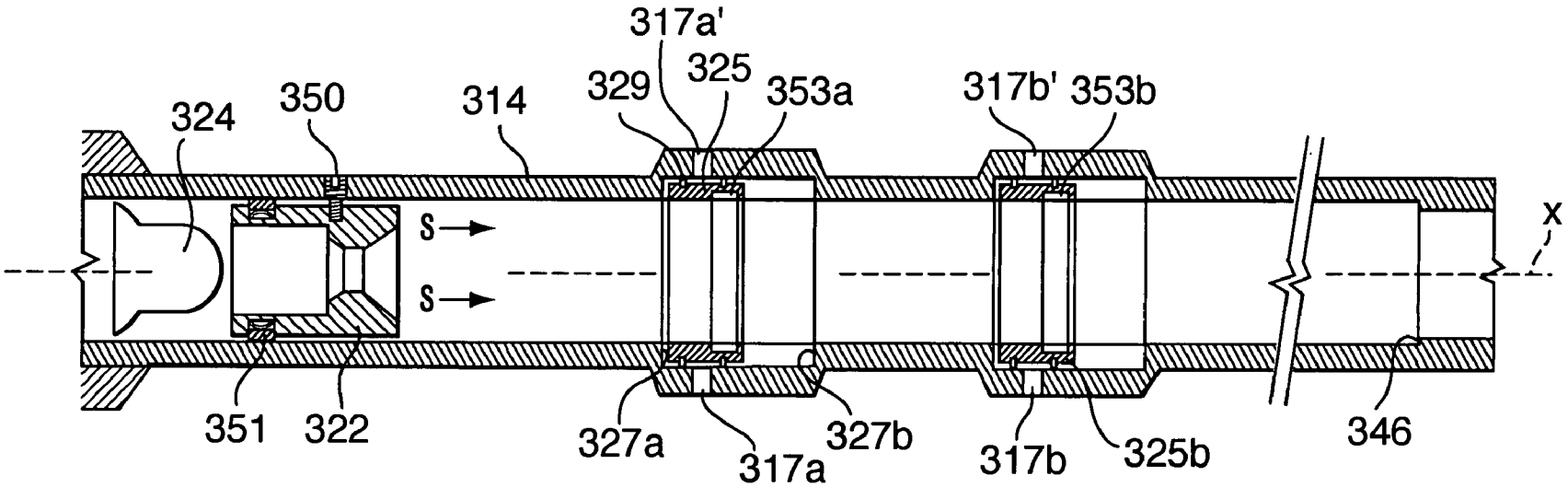
FIG. 6 is a sectional view along the long axis of a tubing string according to the present invention containing a sleeve and axially spaced fluid treatment ports.

Referring to FIG. 6, there is shown another tubing string 314 according to the present invention. The tubing string includes an axially movable sleeve 322 and a plurality of normally closed ports 317*a*, 317*a*', 317*b*, 317*b*'. Ports 317*a*, 317*a*' are spaced from each other on the tubing circumference. Ports 317*b*, 317*b*' are also spaced circumferentially in a plane orthogonal to the long axis of the tubing string. Ports 317*a*, 317*a*' are spaced from ports 317*b*, 317*b*' along the long axis x of the string.

Sleeve 322 is normally mounted by shear 350 in the tubing string. However, fluid pressure created by seating of a plug 324 in the sleeve, can cause the shear to be sheared and the sleeve to be driven along the tubing string until it butts against a shoulder 346.

Ports 317*a*, 317*a*' have positioned thereover a port-closing sleeve 325*a* and ports 317*b*, 317*b*' have positioned thereover a port closing sleeve 325*b*. The sleeves act as valves to seal against fluid flow though their associated ports, when they are positioned thereover. However, sleeves 325*a*, 325*b* can be moved axially along the tubing string to exposed their associated ports, permitting fluid flow therethrough. In particular, with reference to ports 317*a*, 317*a*', each set of ports includes an associated sliding sleeve disposed in a cylindrical groove, defined by shoulders 327*a*, 327*b* about the port. The groove is formed in the inner wall of the tubing string and sleeve 325*a* is selected to have an inner diameter that is generally equal to the tubing string inner diameter and an outer diameter that substantially conforms to, but is slidable along, the groove between shoulders 327*a*, 327*b*. Seals 329 are provided between sleeve 325*a* and the groove, such that fluid leakage therebetween is substantially avoided.

The port closing sleeves, for example 325*a*, are normally positioned over their associated ports 317*a*, 317*a*' adjacent shoulder 327*a*, but can be slid along the groove until stopped by shoulder 327*b*. In each case, the shoulder 327*b* is spaced from its ports with consideration as to the length of the associated sleeve so that when the sleeve is butted against shoulder 327*b*, the port is open to allow at least some fluid flow therethrough.

The port-closing sleeves 325*a*, 325*b* are each formed to be engaged and moved by sleeve 322 as it passes through the tubing string from its pinned position to its position against shoulder 346. In the illustrated embodiments, sleeves 325*a*, 325*b* are moved by engagement of outwardly biased dogs 351 on the sleeve 322. In particular, each sleeve 325*a*, 325*b* includes a profile 353*a*, 353*b* into which dogs 351 can releasably engage. The spring force of dogs and the co acting configurations of profiles and the dogs are together selected to be greater than the resistance of sleeve 325 moving within the groove, but less than the fluid pressure selected to be applied against ball 324, such that when sleeve 322 is driven through the tubing string, it will engage against each sleeve 325*a* to move it away from its ports 317*a*, 317*a*' and against its associated shoulder 327*b*. However, continued application of fluid pressure will drive the dogs 351 of the sleeve 322 to collapse, overcoming their spring force, to remove the sleeve from engagement with a first port-closing sleeve 325*a*, along the tubing string 314 and into engagement with the profile 353*b* of the next-port associated sleeve 325*b* to move that sleeve and open ports 317*b*, 317*b*' and so on, until sleeve 322 stopped against shoulder 346.

Referring to FIGS. 7*a* to 7*d*, the wellbore fluid treatment assemblies described above can also be combined with a series of ball activated focused approach sliding sleeves and packers as described in applicant's corresponding U.S. Application 2003/0127227 to allow some segments of the well to be stimulated using a sprinkler approach and other segments of the well to be stimulated using a focused fracturing approach.

In this embodiment, a tubing or casing string 414 is made up with two ported intervals 316*b*, 316*d* formed of subs having a series of size restricted ports 317 therethrough and in which the ports are each covered, for example, with protective pressure holding internal caps and in which each interval includes a movable sleeve 322*b*, 322*d* with profiles that can act as a cutter to cut off the protective caps to open the ports. Other ported intervals 16*a*, 16*c* include a plurality of ports 417 disposed about a circumference of the tubing string and are closed by a ball or plug activated sliding sleeves 22*a*, 22*c*. Packers 420*a*, 420*b*, 420*c*, 420*d* are disposed between each interval to create isolated segments along the wellbore 412.

Once the system is run into the well (FIG. 7*a*), the tubing string can be pressured to set some or all of the open hole packers. When the packers are set, stimulation fluids are pumped into the end section of the tubing to begin the stimulation treatment, identified as stage 1 sprinkler treatment in the illustrated embodiment. Initially, fluids will be forced to the lower section of the well below packer 420*d*. In stage 2, shown in FIG. 7*b*, a focused frac is conducted between packers 420*c* and 420*d*; in stage 3, shown in FIG.

Figure 7A:
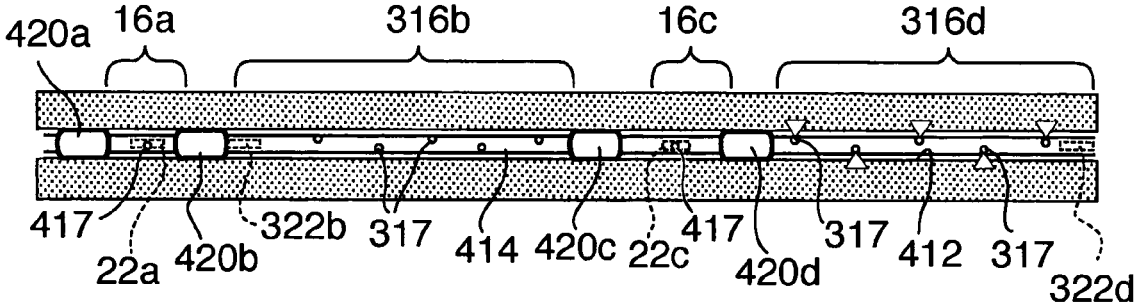
FIG. 7*a* is a section through a wellbore having positioned therein another fluid treatment assembly according to the present invention, the fluid treatment assembly being in a first stage of wellbore treatment.
Figure 7B:
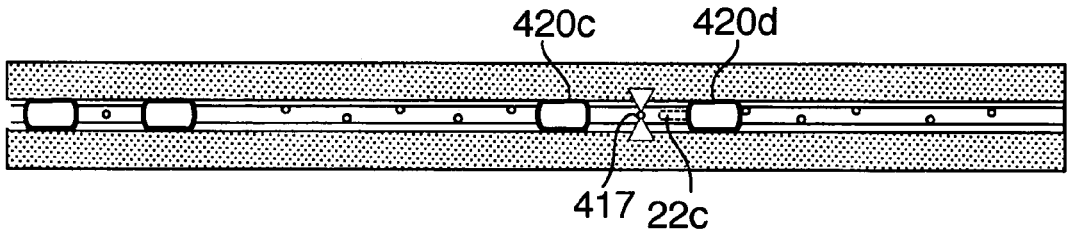
FIG. 7*b* is a section through the wellbore of FIG. 7*a* with the fluid treatment assembly in a second stage of wellbore treatment.
Figure 7C:
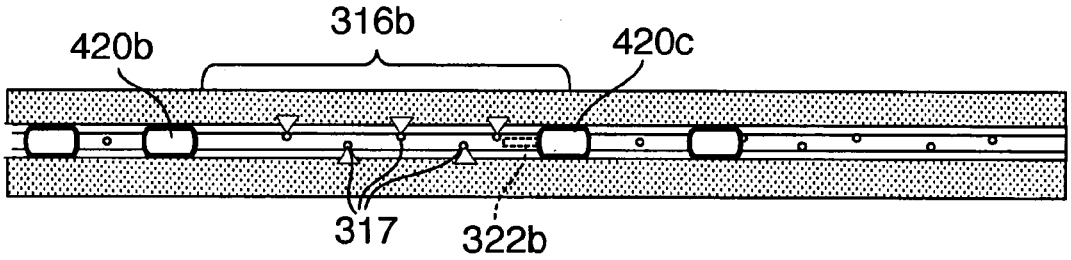
FIG. 7*c* is a section through the wellbore of FIG. 7*a* with the fluid treatment assembly in a third stage of wellbore treatment.
Figure 7D:
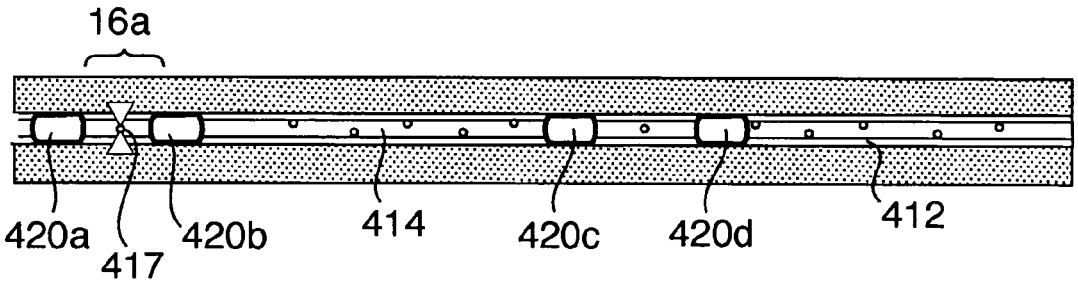
FIG. 7*d* is a section through the wellbore of FIG. 7*a* with the fluid treatment assembly in a fourth stage of wellbore treatment.

7*c*, a sprinkler approach is used between packers 420*b* and 420*c*; and in stage 4, shown in FIG. 7*d*, a focused frac is conducted between packers 420*a* and 420*b*.

Sections of the well that use a "sprinkler approach", intervals 316*b*, 316*d*, will be treated as follows: When desired, a ball or plug is pumped down the well, and will seat in one of the cutter sleeves 322*b*, 322*d*. The force of the moving fluid will push the cutter sleeve down the tubing string and as it moves down, it will remove the pressure holding caps from the segment of the well through which it passes. Once the cutter reaches a desired depth, it will be stopped by a no-go shoulder and the ball will remain in the sleeve effectively shutting off the lower segment of the well. Stimulation fluids are then pumped as required.

Segments of the well that use a "focused stimulation approach", intervals 16*a*, 16*c*, will be treated as follows: Another ball or plug is launched and will seat in and shift open a pressure shifted sliding sleeve 22*a*, 22*c*, and block off the lower segment(s) of the well. Stimulation fluids are directed out the ports 417 exposed for fluid flow by moving the sliding sleeve.

Fluid passing through each interval is contained by the packers 420*a* to 420*d* on either side of that interval to allow for treating only that section of the well.

The stimulation process can be continued using "sprinkler" and/or "focused" placement of fluids, depending on the segment which is opened along the tubing string.

It will be apparent that changes may be made to the illustrative embodiments, while falling within the scope of the invention and it is intended that all such changes be covered by the claims appended hereto.

The invention claimed is:

1. An apparatus for fluid treatment of a borehole, the apparatus comprising a tubing string having a long axis and a wall defining an inner bore, a plurality of closures accessible from the inner bore of the tubing string, each closure closing a port extending through the wall of the tubing string and preventing fluid flow through its port, but being openable to permit fluid flow through its port and each closure openable independently from each other closure, a port-opening sleeve positioned in the tubing string and driveable through the tubing string to actuate the plurality of closures to open the ports, the port-opening sleeve being driveable by plugging the sleeve with a sealing device and applying fluid pressure to move the sleeve and a second port-opening sleeve for opening a second plurality of closures.

2. The apparatus of claim 1 wherein at least one of the plurality of closures includes a cap extending into the tubing string inner bore, the cap being openable by movement therepast of the port-opening sleeve.

3. The apparatus of claim 2 wherein the cap is opened by engagement thereagainst by the port-opening sleeve.

4. The apparatus of claim 3 wherein cap is shearable by the port-opening sleeve.

5. The apparatus of claim 1 wherein at least one of the plurality of closures includes a port-closure sleeve covering its port, the port-closure sleeve being moveable to expose its port by engagement of the port-opening sleeve to move the port-closure sleeve along the tubing string.

6. The apparatus of claim 5 wherein the port-closure sleeve includes a profile and the port-opening sleeve includes a locking dog biased outwardly therefrom and selected to lock into the profile on the port-closure sleeve.

7. The apparatus of claim 1 wherein the sealing device can seal against fluid passage past the port-opening sleeve.

8. The apparatus of claim 1 wherein the port-opening sleeve has formed thereon a seat and the sealing device is a plug.

9. The apparatus of claim 1 wherein the port-opening sleeve has formed thereon a seat and the sealing device is a ball selected to seal against the seat.

10. The apparatus of claim 1 further comprising a packer disposed about the tubing string.

11. The apparatus of claim 10 wherein the packer is a solid body packer including multiple packing elements.

12. The apparatus of claim 11 wherein the multiple packing elements are spaced apart.

* * * * *